US006918444B2

(12) United States Patent
Passey et al.

(10) Patent No.: US 6,918,444 B2
(45) Date of Patent: Jul. 19, 2005

(54) METHOD FOR PRODUCTION OF HYDROCARBONS FROM ORGANIC-RICH ROCK

(75) Inventors: Quinn R. Passey, Kingwood, TX (US); Michele M. Thomas, Houston, TX (US); Kevin M. Bohacs, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 918 days.

(21) Appl. No.: 09/812,184

(22) Filed: Mar. 19, 2001

(65) Prior Publication Data

US 2001/0049342 A1 Dec. 6, 2001

Related U.S. Application Data

(60) Provisional application No. 60/198,301, filed on Apr. 19, 2000.

(51) Int. Cl.[7] ..... E21B 43/00
(52) U.S. Cl. ..... 166/258
(58) Field of Search ..... 166/256–262

(56) References Cited

U.S. PATENT DOCUMENTS

| | | | | |
|---|---|---|---|---|
| 2,584,605 A | * | 2/1952 | Merriam et al. | 166/257 |
| 3,284,281 A | | 11/1966 | Thomas | 166/2 |
| 3,599,714 A | * | 8/1971 | Messman et al. | 166/258 |
| 3,661,423 A | | 5/1972 | Garrett | 299/2 |
| 3,741,306 A | | 6/1973 | Papadopoulos et al. | 166/252 |
| 3,924,680 A | * | 12/1975 | Terry | 166/258 |
| 4,047,760 A | | 9/1977 | Ridley | 299/2 |
| 4,149,595 A | | 4/1979 | Cha | 166/259 |
| 4,163,475 A | | 8/1979 | Cha et al. | 166/251 |
| 4,167,291 A | | 9/1979 | Ridley | 299/2 |
| 4,185,693 A | | 1/1980 | Crumb et al. | 166/259 |
| 4,369,842 A | | 1/1983 | Cha | 166/251 |
| 4,487,260 A | | 12/1984 | Pittman et al. | 166/259 |
| 4,886,118 A | | 12/1989 | Van Meurs et al. | 166/245 |
| 5,868,202 A | | 2/1999 | Hsu | 166/256 |

OTHER PUBLICATIONS

Berry, K. L., Hutson, R. L., Sterrett, J. S., and Knepper, J. C. 1982, Modified in–situ retoring results of two field reports, Gary, J.H., ed., 15th Oil Shale Symp., CMS, p. 385–396.

Bridges, J. E., Krstansky, J. J., Taflove, A., and Sresty, G., 1983, The IITRI in situ RF fuel recovery process, J. of Microwave Power, v. 18, p. 3–14.

Chute, F. S., and Vermeulen, F. E., 1988, Present and potential applications of electromagnetic heating in the in–situ recovery of oil, AOSTRA J. Res., v. 4, p. 19–33.

Covell, J. R., Fahy, J. L., Schreiber, J., Sudduth, B. C., and Trudell, L., Indirect in situ retorting of oil shale using the TREE process, Gary, J. H., ed., 17th Oil Shale Symposium Proceedings, Colorado School of Mines, p. 46–58.

Farouq Ali, S. M., 1994, Redeeming features of in situ combustion, DOE/NIPER Symposium on In Situ Combustion Practices–Past, Present, and Future Application, Tulsa, OK, Apr. 21–22, No. ISC 1, p. 3–8.

(Continued)

*Primary Examiner*—John Kreck

(57) ABSTRACT

A method for accelerating the conversion of kerogen to hydrocarbons in a subterranean formation containing organic-rich rock that is located in the vicinity of reservoir-quality strata. Sufficient heat is generated in the reservoir-quality strata such that it heats the organic-rich rock in the subterranean formation and accelerates the conversion of kerogen to hydrocarbons in the formation.

13 Claims, 2 Drawing Sheets

OTHER PUBLICATIONS

Garthoffner, E. H., 1998, Combustion front and burned zone growth in successful California ISC projects, SPE 46244, p. 1–11.

Greaves, M., Wang, Y. D., and A1–Shamali, O., 1994, In situ combustion (ISC) processes:3D studies of vertical and horizontal wells, Europe Symp. Heavy Oil Technology in a Wider Europe, Berlin, Jun. 7–8, p. 89–112.

Humphrey, J. P., 1978, Energy from in situ processing of Antrim oil shale, DOE Report FE–2346–29.

Lekas, M. A., Lekas, M. J., and Strickland, F. G., 1991, Initial evaluation of fracturing oil shale with propellants for in situ retorting—Phase 2, Abstract of DOE Report DOE/MC/11O76–3064.

Oil & Gas Journal, 1998, Aussie oil shale project moves to Stage 2, Oct. 26, p. 42.

Riva, D. and Hopkins, P., 1998, Suncor down under: the Stuart Oil Shale Project, Annual Meeting of the Canadian Inst. of Mining, Metallurgy, and Petroleum, Montreal, May 3–7.

Salamonsson, G., 1951, The Ljungstrom in–situ method for shale–oil recovery, Sell, G., ed., Proc. of the 2nd Oil Shale and Cannel Coal Conf., v. 2, Glasgow, Jul. 1950, Institute of Petroleum, London, p. 260–280.

Stevens, A. L.,, and Zahradnik, R. L., 1983, Results from the simultaneous processing of modified in situ retorts 7&8, Gary, J. H., ed., 16th Oil shale Symp., CSM, p. 267–280.

Tissot, B. P., and Welte, D. H., 1984, Petroleum Formation and Occurrence, New York, Springer–Verlag, p. 131–198, 254–267.

Turta, A., 1994, In situ combustion– from pilot to commercial application, DOE/NIPER Symposium on In Situ Combustion practices–Past, Present, and Future Application, Tulsa, OK, Apr. 21–22, No. ISC 3, p. 15–39.

Tyner, C. E., Parrish, R. L., and Major, B. H., 1982, Sandia/Geokinetics Retort 23: a horizontal in situ retorting experiment, Gary, J. H., ed., 15th Oil Shale Symp., CSM, p. 370–384.

Tzanco, E. T., Moore, R. G., Belgrave, J. D. M., and Ursenbach, M. G., 1990, Laboratory combustion behavior of Countess B light oil, Petroleum Soc. of CIM and SPE, Calgary, Jun. 10–13, No. CIM/SPE 90–63, p. 63.1–63.16.

Vermeulen, F. E., 1989, Electrical heating of reservoirs, Helper, L., and Hsi, C., eds., AOSTRA Technical Handbook on Oil Sands, Bitumens, and Heavy Oils, Chapt. 13, p. 339–376.

Yen, T. F., and Chilingarian, G. V., 1976, Oil Shale, Amsterdam, Elsevier, p. 1–12, 181–198.

* cited by examiner

METHOD FOR PRODUCTION OF HYDROCARBONS FROM ORGANIC-RICH ROCK

CROSS-REFERENCE

This application claims the benefit of U.S. Provisional Application No. 60/198,301 filed Apr. 19, 2000.

FIELD OF THE INVENTION

This invention relates to the production of hydrocarbons from organic-rich rock such as kerogen-bearing, subterranean shale formations. More specifically, the invention relates to using reservoir quality strata as a heat source for conversion of the kerogen to hydrocarbons.

BACKGROUND OF THE INTENTION

Ever since the commercial use and production of liquid hydrocarbons commenced in the mid-19th century, scientists have pursued ways of economically extracting hydrocarbons from organic-rich rocks such as oil shale. Historically and currently, almost all hydrocarbons are produced from subterranean reservoir strata and formations. Such hydrocarbon-bearing reservoirs, containing natural gas and/or oil, typically comprise permeable and porous rock such as sandstone or limestone (carbonate). Frequently, these types of rocks serve as traps for hydrocarbons and can be commercially exploited as oil or gas reservoirs. Once penetrated by a well, reservoir strata may be able to produce hydrocarbons in commercial quantities. Occasionally, well treatment techniques such as fracturing or acidizing will be needed to enhance or accelerate production from these reservoirs.

Reservoir strata and formations such as sandstone and carbonate are not, however, the original source of the hydrocarbons. The reservoirs are usually the rocks into which the hydrocarbons have migrated over geologic time. The actual so-called "source rocks" are the organic-rich rocks from which the hydrocarbons originally derive. A common source rock is shale which contains a hydrocarbon precursor known as kerogen. The kerogen is a complex organic material that is the product of the initial biologic organic matter that was buried with the soils and clays which ultimately formed the shale rocks. The kerogen is generally tightly bound within the rock and only gets converted to hydrocarbons when it is exposed to temperatures over 100° C., typically under deep burial. This process is extremely slow and takes place over geologic time. Eventually, under the right conditions, the hydrocarbons within the shale or other source rocks will migrate (often through natural fissures, fractures and faults) until they reach a reservoir trap such as a sandstone or carbonate formation.

Source rocks that have yet to liberate their kerogen in the form of hydrocarbons are known as "immature" source rocks. These immature source rocks, however, contain the overwhelming majority of buried organic matter in the earth's crust. It is estimated that less than 1% of the organic matter is in the form of is hydrocarbons contained in reservoir rocks. The great majority is still present as kerogen and thus represents a vast untapped energy source.

Unfortunately, kerogen is not readily liberated from shale or other source rocks. Kerogen-bearing rocks near the surface can be mined and crushed and, in a process known as retorting, the crushed shale can then be heated to high temperatures which convert the kerogen to liquid hydrocarbons. Commercial and experimental mining and retorting methods for producing hydrocarbons from shale have been conducted since 1862 in various countries around the world. In the 1970s and 1980s several oil companies conducted pilot plant shale oil operations in the Piceance Basin of Colorado where large, high-quality reserves of oil shale are located. A more current project is the Stuart Oil Shale Project in Australia which uses a rotating retort to heat the shale to 500° C. There are a number of drawbacks to surface production of shale oil which has made its production more costly compared to conventional hydrocarbon production. These drawbacks include the high costs of mining, crushing, and retorting the shale and the environmental cost of shale rubble disposal, site remediation, and clean operation of the retort and associated plant.

Because of the high costs associated with surface shale oil production and because most of the shale is located at depths too deep to mine, attempts have been made to produce shale oil using in situ processes. In situ processing eliminates the costs associated with the mining, crushing, handling and disposal of the shale rock. Techniques for in situ retorting of oil shale were pilot tested with Green River oil shale in Colorado in the 1970s and 1980s. With the in situ process the oil shale is first rubblized into large fragments with explosives and then the kerogen is subjected to in situ combustion by air injection into the shale formation. In pilot operations by Occidental Petroleum and Rio Blanco in the 1970s and 1980s, air was injected at the top of the rubblized zone. The oil shale was then ignited, and the combustion front moved downward through the zone. Retorted oil drained to the bottom of the zone and was collected. In a different pilot project designed by Geokinetics, air was injected into wellbores at one end of the rubblized zone and the combustion front moved horizontally. The shale was retorted ahead of the combustion front and the resulting oil again drained to the bottom of the rubble and was produced from wells located at the opposite end of the rubblized volume.

A variation on the usual process for in situ conversion of rubblized oil shale utilizes hot flue gases from underground coal conversion. In this proposed process, a shallow shale bed is rubblized in preparation for a horizontal retort. In situ gasification and combustion are established in a nearby coal formation separated from the oil shale by a "barren" formation (so that combustion does not start in the rubblized oil shale). Hot, inert flue gases from the coal conversion are delivered to one end of the rubblized shale bed through a well that links the coal formation to the shale formation. The hot flue gases pass horizontally through the rubblized shale bed, retorting the oil shale, and sweeping the shale oil to production wells. Operating periods are estimated to be about 20 days. As with other in situ oil shale retorts, the shale rubblization involved in this process limits it to very shallow depths.

U.S. Pat. No. 5,868,202 describes a process for using an adjacent "source" aquifer or fracture to deliver an extracting fluid containing fuel and oxygen to an oil shale. The ignited extracting fluid migrates under pressure through the shales, extracting thermal energy, hot gases, or hydrocarbons. The extraction products migrate into an adjacent "sink" aquifer from which they are produced. This process is very difficult to manage because it requires a controlled flow of the extracting fluid through the oil shale.

Other in situ processes have involved directly heating the oil shale other than by combustion. Some attempts have been made to use microwave or other electromagnetic heating to heat the source rocks. A more direct approach, initially developed in Sweden, relied on thermal conduction from heated wellbores. The most recent of these processes utilized heat generated by either electrical resistance or gas-fired heaters to raise wellbore temperatures up to 600° C. With test wells spaced 0.6 m apart, the shale formation reached temperatures of about 300° C. and produced oil. However, with this method, spacing of the wells is extremely close and many wells would be required to achieve commercial production volumes of hydrocarbons.

Overall, the various in situ processes for producing oil shale have been commercially unattractive. Therefore, what is needed is an in situ method that effectively converts kerogen to producible hydrocarbons such that kerogen-bearing shale formations can become commercially exploitable.

SUMMARY OF THE INVENTION

This invention is directed to a method for accelerating the conversion of kerogen to hydrocarbons in a subterranean formation. The subterranean formation contains organic-rich rock, such as oil shale, and is located in the vicinity of reservoir-quality strata. Preferably, the reservoir-quality strata underlie the organic-rich rock. Heat is generated in the reservoir-quality strata in an amount sufficient to accelerate conversion of the kerogen to hydrocarbons in the organic-rich rock.

In one embodiment of the invention, the in situ combustion of hydrocarbons in the reservoir-quality strata is used to generate heat. Preferably, the hydrocarbons are naturally present in the strata. Combustion can be supported with the injection of air or oxygen-bearing gas into the strata. Although a combustion process is preferred, heat may also be generated in the strata by the injection of superheated steam or by the creation of an exothermic chemical reaction.

The temperature in some portion of the subterranean formation containing the organic-rich rock must be raised to a level at which conversion of kerogen to hydrocarbons is accelerated. To attain a practical conversion rate of kerogen to hydrocarbons, the preferred temperature should be at least about 220° C. and more preferably in excess of about 250° C.

In one embodiment of the invention, a reservoir formation containing hydrocarbons is located in the vicinity of a kerogen-bearing subterranean formation, preferably underlying the kerogen-bearing formation. An oxygen-bearing gas, such as air, is injected into the reservoir and is combusted with the hydrocarbons in the reservoir. The combustion process generates heat within the reservoir which is transferred to the kerogen-bearing formation and raises the temperature within a portion of the formation to at least about 220° C. and, preferably, to at least about 250° C. The generated heat accelerates the conversion of the kerogen to hydrocarbons and, at the temperatures indicated above, conversion will take place at a commercially acceptable level.

DETAILED DESCRIPTION OF THE INVENTION

Figure 1:
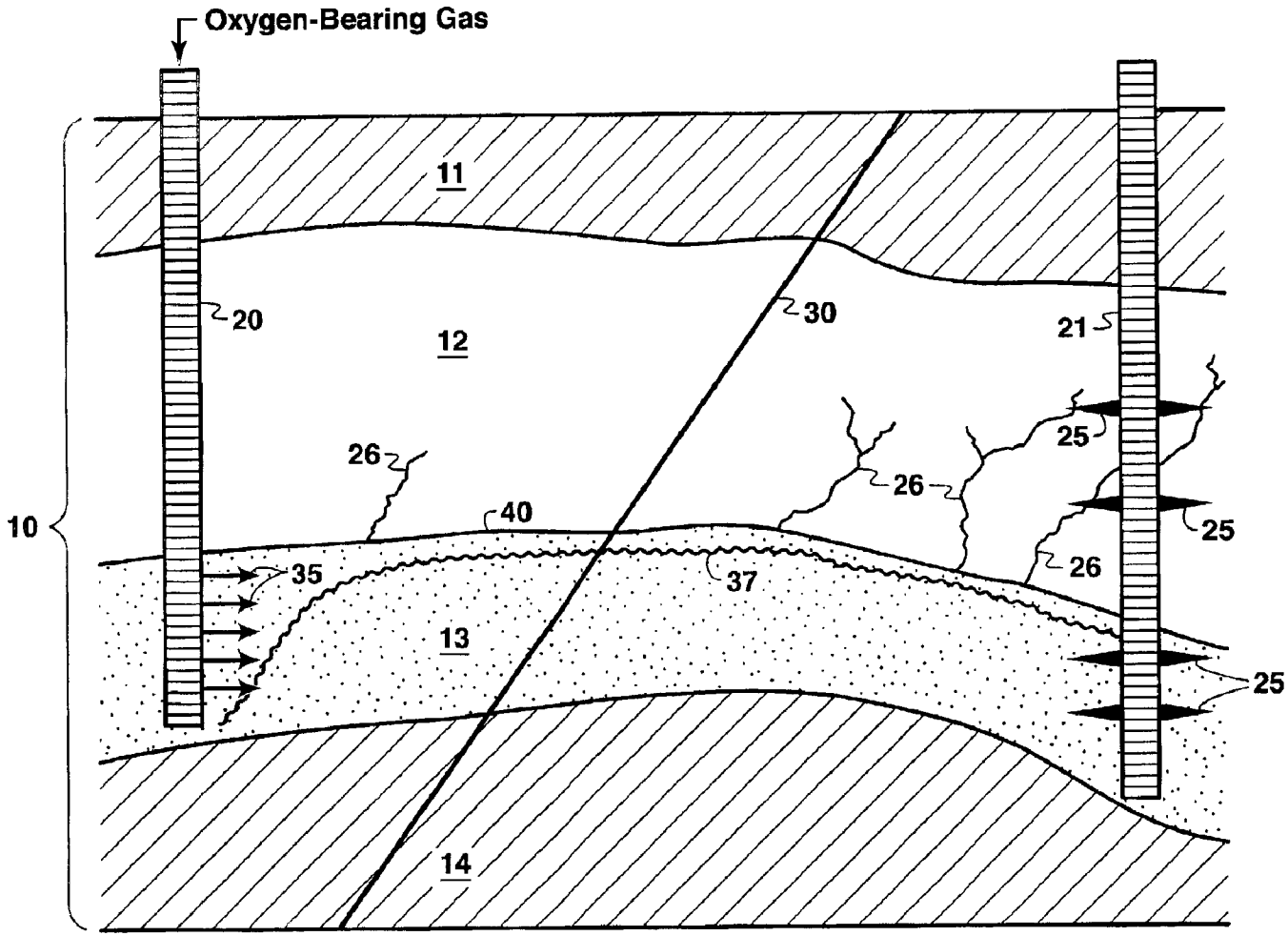
FIG. 1 is a schematic vertical cross-section depicting a shale formation which overlies reservoir-quality strata.

The method of this invention overcomes the limitations of the prior art and enables the commercial development of organic-rich rocks such as oil shale. The method solves the problem of providing a sustained, high intensity and penetrating heat source to convert kerogen to producible hydrocarbons by using reservoir-quality strata in the vicinity of the organic-rich rocks as a heat source.

In the method of this invention, in situ recovery of hydrocarbons from shale can be achieved without rubblizing the organic-rich rocks to allow the injection of fluids into them. Instead the method utilizes a nearby or adjacent reservoir, such as a partially depleted oil or gas reservoir, as the source of heat that is conducted into the formation containing the organic-rich rocks. This method, therefore, avoids costly rubblization and the drilling of multiple, closely spaced wells which are used as heat sources, but which have limited penetrating range.

In a preferred embodiment of the invention, a partially depleted oil or gas reservoir which underlies a formation containing organic-rich rocks can be used as the heat source. The residual oil and/or gas in the reservoir would serve as a fuel source for in situ combustion within the reservoir thereby generating intense heat below the overlying organic-rich formation.

Although there are other embodiments of the invention that will be discussed below, it should be understood that the method of the invention broadly relates to utilizing reservoir strata to generate and transfer heat (primarily by conduction) to a formation containing organic-rich rocks such as shale. For its use in this specification and in the claims, the term "shale formation" hereinafter refers to any deposits of organic-rich rock including but not limited to shale, oil shale, marl, micrite, diatomite or other rocks that might be deemed by those skilled in the art as potential source rocks containing kerogen or related organic matter imbedded in the rocks. The deposits of organic-rich rock may be continuous or discontinuous. Thus a "shale formation" would include deposits of organic-rich rock such as shale that were interspersed with other rocks or deposits that were not potentially source rocks.

Similarly, the phrases "reservoir strata" or "reservoir formation" or the word "reservoir" refers to any geologic formation having sufficient porosity or permeability such that it contains or is capable of containing hydrocarbons such as oil or gas. The reservoir strata may be in the form of a continuous reservoir, or portion thereof, such as a sandstone or carbonate reservoir that is typically found in oil or gas producing regions of the world. However, the reservoir strata may also be in the form of discontinuous units such as lenticular sand deposits.

The use of the word "kerogen" is also intended to encompass a broad range of organic matter that may be imbedded in shale or other source rocks and should not be limited to any specific composition or structure. "Kerogen" shall include the polymeric-like organic matter typically found in shale rock as well as all other types of organic matter including hydrocarbons and hydrocarbon precursors that may be contained within a source rock. The use of the word "hydrocarbon" is also intended to broadly encompass not only molecular hydrocarbons but also more complex organic matter such as asphaltenes, resins, bitumen and organic matter containing elements other than hydrogen and carbon, such as oxygen, nitrogen and sulfur.

Referring more particularly to the drawings, FIG. 1 illustrates a vertical cross section 10 comprising four distinct formations of subterranean rock. At the top of cross section 10 is formation 11 of an unspecified composition. A similar formation 14 is depicted at the bottom of cross section 10.

Also within cross section 10 is an organic-rich formation 12 located directly above reservoir 13. In this example, reservoir 13 is depicted as a sandstone reservoir and formation 12 is depicted as shale. Likewise reservoir 13 may also comprise carbonate rock or a mixture of rocks that give it the permeability and porosity that are within the ranges typically characterized for reservoir-quality strata. For example, to be considered reservoir-quality strata the rocks should have permeability that is at least approximately $10^{-6}$ Darcy and a porosity at least approximately 5%. Those skilled in the art will be able to identify source rock formations and reservoir-quality strata.

Also depicted in FIG. 1 are two wells 20 and 21, situated a distance apart from one another. Although depicted as vertical wells in FIG. 1, wells 20 and 21 could also be deviated or horizontal wells. At one time both of these wells may have been drilled for the purpose of producing oil or natural gas from reservoir 13. Alternatively, one or both of the wells shown could have been drilled for the sole purpose of practicing the present invention or for other purposes such as gas or fluid injection associated with enhanced oil recovery or waste disposal. Clearly, the costs associated with practicing the invention will be lower if there are preexisting wells in place.

To illustrate the invention, well 20 is depicted as an injection well and well 21 as a producing well. Throughout the area surrounding wells 20 and 21 there may also be numerous other wells which can likewise serve the purpose of injection and production wells. Additional wells may also be drilled as needed to practice the invention.

Other characteristics of the wells and formations depicted in FIG. 1 are hydraulic fractures 25, natural fractures 26 and diagonal fault 30. Fault 30 is a major fault line bisecting the entirety of the cross-section. As a fault it represents a pathway along which fluids can flow and may have served as a conduit for hydrocarbons to flow from source rocks (not shown) that are above or below cross-section 10 into reservoir 13 over geologic time. As will be shown, fault 30 and natural fractures 26 in shale formation 12 may provide pathways for converted kerogen hydrocarbons to flow directly to production well 21 or into reservoir 13 over a relatively short period of time as the present invention is practiced. These natural pathways for fluid flow may be enhanced by artificially induced pathways such as hydraulic fractures 25. Hydraulic fractures 25 may be pre-existing such those shown in reservoir 13 which could have served the purpose of stimulating oil or gas production from reservoir 13. The fractures 25 such as those shown in shale formation 12, may also be induced for the sole purpose of enhancing the practice of the invention. (Normally, formation 12 would not be hydraulically fractured during the original development of reservoir 13 since formation 12 is not a reservoir-quality strata capable of normal hydrocarbon production.)

The invention involves utilizing reservoir 13 as a heat source. Preferably, reservoir 13 will be a hydrocarbon-bearing formation that contains sufficient quantities of hydrocarbons to support and maintain combustion in the presence of oxygen. In many instances reservoir 13 could be one which produced commercial quantities of hydrocarbons and is near the end of its economic life or is no longer actively producing hydrocarbons. Assuming there are sufficient quantities of hydrocarbons remaining in the reservoir to sustain combustion, the reservoir can be utilized as a heat source. If reservoir 13 does not contain sufficient combustible hydrocarbons, then the injection of combustible hydrocarbons such as natural gas may be necessary. Well 20 may be used for the injection of combustible hydrocarbons into reservoir 13.

Assuming reservoir 13 has an adequate supply of combustible hydrocarbons, well 20 is used to inject air or an oxygen-containing gas into the well to mix with the hydrocarbons and form a combustible mixture. The flow of the air or oxygen into reservoir 13 is depicted by arrows 35. The reservoir hydrocarbons are then ignited to commence the in situ combustion process. As combustion progresses into reservoir 13, additional air or oxygen is injected to sustain combustion. The combustion front may be vertical or horizontal. As illustrated in FIG. 1, the combustion front 37 is a predominantly horizontal combustion surface except near the injection well where it is substantially vertical. It should be understood that FIG. 1 illustrates only one embodiment of the combustion front. The combustion process is very complex and the orientation and location of the combustion front will depend on many parameters including the location and orientation of the injection well and the characteristics of the reservoir.

As in situ combustion of the hydrocarbons continues significant quantities of heat are generated. Hot combustion gases and conducted heat from reservoir 13 will begin to gradually transfer heat to formation 12. Because formation 12 is substantially impermeable, heat will move into it primarily by conduction. However, hot combustion gases may also permeate into open channels and pathways such as fault 30, natural fractures 26 and hydraulic fractures 25. These incidental pathways may also contribute to the heating of formation 12.

Figure 2:
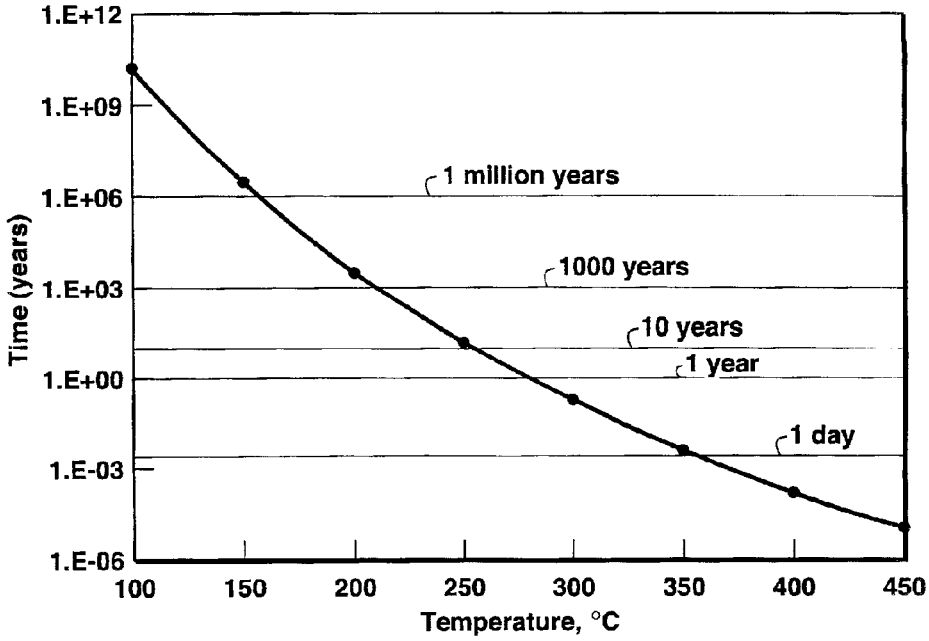
FIG. 2 is a graph correlating kerogen conversion rates with temperature for a typical source rock.

Temperatures generated in reservoir 13 might rise in excess of 500° C. As heat is conducted into formation 12, its temperatures will also gradually rise commencing at interface 40 and along fractures 26 and fault line 30 which are in communication with reservoir 13. It is preferred for temperatures in formation 12 to eventually rise above 250° C. and more preferably rise to a range of 260° C.–290° C. As shown in FIG. 2, higher temperatures greatly accelerate the conversion of kerogen (contained in the organic-rich source rock) to hydrocarbons. For a typical marine, oil-prone kerogen, as shown in FIG. 2, 75% conversion of kerogen to hydrocarbons requires more than 1 million years at temperatures below about 150° C. At about 200° C. the time to 75% conversion drops a thousand-fold to 1,000 years, still too slow for commercial purposes. However, at 250° C. there is a further one hundred-fold reduction in time to 10 years which places the conversion timetable within a commercially acceptable range. At the preferred range of 260° C.–290° C. conversion times fall to 1 year or less. Other source rocks and kerogen types will exhibit similar time-temperature relationships for conversion. In the broad range of potential source rocks, commercially acceptable conversion rates may occur at temperatures ranging between about 220° C. to about 330° C. For most source rocks, such conversion will occur at temperatures between about 250° C. to about 300° C.

Figure 3:
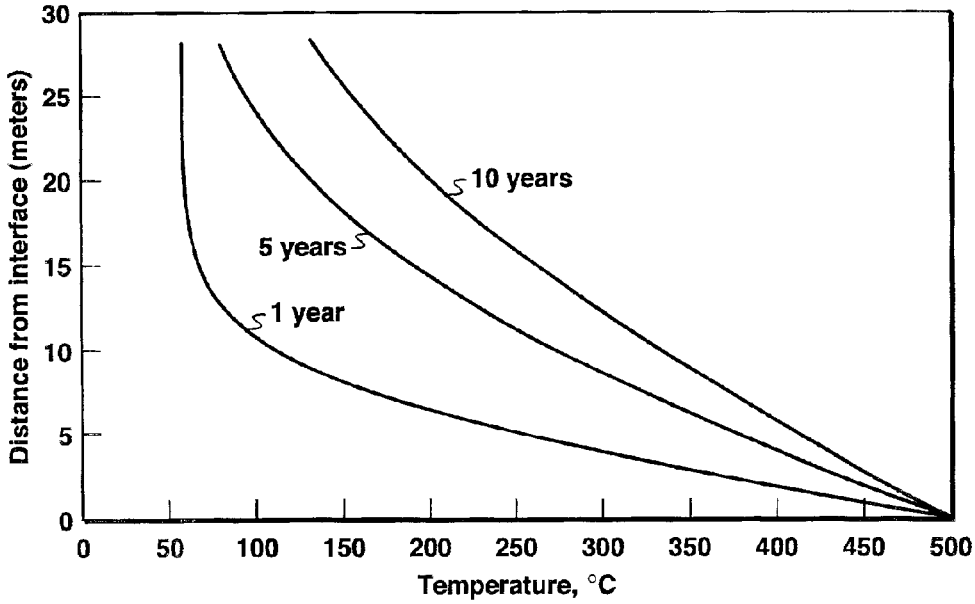
FIG. 3 is a graph correlating temperature in a shale source rock with distance (within the shale rock) from a high temperature heat source at the boundary of the shale rock

Temperatures, of course, cannot be uniform throughout formation 12. Heat conduction is distance dependent and the farther away from interface 40 (in FIG. 1) the lower the temperature is likely to be and the lower the kerogen to hydrocarbon conversion rate. FIG. 3 illustrates typical temperature profiles for a shale rock formation that has been subjected to heat conduction for periods of about 1, 5 and 10 years. It is assumed that the starting temperature of the shale formation is about 60° C. and the temperature at the interface with the heat source is 500° C. Even after five years, the temperature drops off rapidly from the interface and falls to 275° C. (the midpoint of the preferred range) at a distance of about 10 meters into the formation. After 10 years the 275° C. temperature boundary will progress about 15 meters from the heat source. Nevertheless, kerogen conversion to a distance of 10–15 meters will generate a large quantity of hydrocarbons.

For a typical marine, oil-prone kerogen, a gram of total organic carbon (TOC) can convert to 600 mg of hydrocarbons at maximum yield and to 450 mg at 75% conversion High quality organic-rich rock has approximately 10 weight % TOC. Therefore, a typical cubic meter of a high quality shale rock contains about 200 kg of total organic carbon and would yield about 0.13 cubic meter (0.8 barrels) of hydrocarbons at 75% conversion. Thus a 10-meter (33 ft) shale formation of 10,000 hectares (25,000 acres) could theoretically contain about $1.3\times10^8$ cubic meters ($8\times10^8$ barrels) of hydrocarbon shale oil that might be producible over a 5–10 year period.

The conversion volumes, rates and times discussed above are illustrative. Higher or lower combustion temperatures could significantly raise or lower kerogen conversion rates and heat penetration depths. Heat penetration and conduction can also be accelerated through natural and induced fractures. As the organic-rich rock is heated and the kerogen conversion process commences, increases in pore pressure within the shale rock may further induce or enhance fractures, microfractures and other fissures in the shale rock thereby further increasing the number of heat penetration pathways.

After a sufficient period of time (generally exceeding one year), generated hydrocarbons can be produced. Production strategies and the location of perforations in the producing wells will depend on where the hydrocarbons flow after conversion. Referring back to FIG. 1, some of the hydrocarbons may flow along fractures 26 and fault 30 down from formation 12 into reservoir 13 and can be produced from the reservoir into wells 20 and 21 or additional new wells. Natural fractures 26 and hydraulic fractures 25 that penetrate formation 12 may also provide permeable paths for hydrocarbon production directly from formation 12. Permeable interbeds contained within formation 12 might also serve as a flow path for converted hydrocarbons.

The in situ combustion process described herein can be conducted in a variety of reservoirs such as heavy oil, conventional oil and natural gas reservoirs; i.e., wherever there is a source of combustible fuel. However, it is preferred that the reservoir formation have high porosity (in excess of 15%) and high residual oil saturation (in excess of 35%). Flue gases from combustion would be removed through wells 20, 21 or other wells in reservoir 13, thereby maintaining the combustion zone near the top of reservoir 13 where heat transfer is most needed. It is also preferred that the reservoir have a high permeability (in excess of $10^{-2}$ Darcy) thereby facilitating gravity override. High permeability also enhances influx of air from injection well 21 into reservoir 13 and removal of flue gas.

As to the quality of the organic-rich source rock, it is preferred that the shale or other source rock contain a relatively high level of total organic carbon, preferably in excess of 10 weight percent. Higher total organic carbon, in addition to increasing the reserve base, also may enhance the permeability of the source rock as the kerogen converts to hydrocarbons. The quality of the kerogen is also important. Kerogen that converts to hydrocarbons at lower temperatures and kerogen that yields a greater amount of hydrocarbons per gram of original TOC (higher HI) are preferred.

Although it is preferred to have an organic rock formation overlie or be interbedded with a substantially horizontal layer of reservoir-quality strata, the present invention is not limited to that type of geology. This invention may be practiced if a more complex geology is present. For example, even if the reservoir-quality strata is discontinuous or lenticular, heat may be delivered to the organic-rich rock by the combustion mechanism described herein. Although the horizontal formations depicted in FIG. 1 are the preferred geologic environment, the present invention may be practiced in any environment where reservoir-quality strata, in which in-situ combustion is taking place, is capable of transferring sufficient heat to organic rich rocks such that conversion of kerogen takes place at an accelerated rate.

Although the embodiments of the invention described herein employ reservoir strata containing sufficient residual hydrocarbons to support combustion, the invention is not limited to such situations. If the reservoir-quality strata is void of hydrocarbons or does not contain sufficient quantities of hydrocarbons to support combustion then, in certain circumstances, it may be economically justifiable to inject combustible hydrocarbons, such as natural gas, into the reservoir along with the injection of oxygen. For example, there may be situations where there are ready sources of natural gas available and where the source rock and reservoir strata are very favorably located. If the source rock is kerogen-rich but the reservoir strata lack combustible hydrocarbons, it may nevertheless be feasible to practice the invention using injected hydrocarbons as a fuel source. In this connection it may also be feasible under certain geological conditions to enhance, supplement or sustain heat generated by combustion with other heat sources injected into the reservoir strata. For example, injection of superheated steam or the generation of exothermic chemical reactions may also be potential sources of heat for the reservoir strata. Those skilled in the art would be able to select the heat source or combination of heat sources in the reservoir most suitable for practicing the invention.

Those skilled in the art will recognize that the methods for production of hydrocarbons from organic-rich rock, as described herein, are not precise. Therefore, limitations of conversion temperatures and rates, production volumes, reservoir and shale formation description and the like should not be read into the present invention. Using the information at hand regarding the shale formation and underlying reservoir, practitioners skilled in the art will be able to use the present invention to economically exploit heretofore non-commercial shale deposits in many areas of the world.

We claim:

1. A method for accelerating the conversion of kerogen to hydrocarbons in a subterranean formation, wherein said subterranean formation contains organic-rich rock and is located in the vicinity of reservoir-quality strata, the method comprising generating sufficient heat in the reservoir-quality strata such that said heat is transferred into the subterranean formation to accelerate conversion of said kerogen in the said formation to quantities of hydrocarbons.

2. The method of claim 1 wherein the heat in the reservoir quality strata is generated through in situ combustion in said reservoir.

3. The method of claim 2 wherein said in situ combustion is supported by the combustion of hydrocarbons within said reservoir-quality strata.

4. The method of claim 3 wherein the combustion of said hydrocarbons is supported with the injection of oxygen-bearing gas into said strata.

5. The method of claim 4 wherein at least a portion of said hydrocarbons are injected into said reservoir-quality strata.

6. The method of claim 1 wherein the heat generated in said reservoir-quality strata is capable of raising the temperature within a portion of said subterranean formation to at least about 220° C.

7. The method of claim 1 wherein the heat generated in said reservoir-quality strata is supported by superheated steam injected in said strata.

8. The method of claim 1 wherein the heat generated in said reservoir-quality strata is supported by an exothermic chemical reaction.

9. A method for accelerating the conversion of kerogen to hydrocarbons from a kerogen-bearing, subterranean formation, wherein said subterranean formation is located in the vicinity of a reservoir formation containing hydrocarbons, the method comprising:

(1) injecting oxygen-bearing gas into said reservoir formation;

(2) creating combustion of the hydrocarbons in said reservoir with oxygen-bearing gas so as to generate sufficient heat in said reservoir formation such that said heat is transferred into said subterranean formation and substantially accelerates conversion of said kerogen to hydrocarbons.

10. The method of claim 9 wherein said kerogen-bearing subterranean formation is in contact with said reservoir formation.

11. The method of claim 9 wherein said reservoir formation comprises subterranean deposits of reservoir-quality strata that are interbedded with said kerogen-bearing subterranean formation.

12. The method of claim 9 wherein the heat generated in said reservoir is capable of raising the temperature within a portion of said subterranean formation to at least about 220° C.

13. A method for accelerating the conversion of kerogen to hydrocarbons from a kerogen-bearing, subterranean formation, wherein said subterranean formation is located in the vicinity of a reservoir formation containing hydrocarbons, the method comprising:

(1) injecting oxygen-bearing gas into said reservoir formation;

(2) creating combustion of the hydrocarbons in said reservoir formation with oxygen-bearing gas so as to create sufficient heat in said reservoir such that said heat is transferred into said subterranean formation and raises the temperature within a portion of said subterranean reservoir to at least about 220° C.

* * * * *